US008272512B2

(12) United States Patent
Joseph

(10) Patent No.: US 8,272,512 B2
(45) Date of Patent: Sep. 25, 2012

(54) FOOD AND DRINK TRAY

(75) Inventor: Silfred Joseph, St. Thomas, VI (US)

(73) Assignees: Silfred Joseph, St. Thomas, VI (US); Ashley Estrada, St. Thomas, VI (US)

( * ) Notice: Subject to any disclaimer, the term of this patent is extended or adjusted under 35 U.S.C. 154(b) by 173 days.

(21) Appl. No.: 12/659,523

(22) Filed: Mar. 11, 2010

(65) Prior Publication Data

US 2010/0230419 A1 Sep. 16, 2010

Related U.S. Application Data

(60) Provisional application No. 61/202,562, filed on Mar. 12, 2009.

(51) Int. Cl.
*B65D 1/34* (2006.01)
*B65D 6/04* (2006.01)
*B65D 25/00* (2006.01)

(52) U.S. Cl. ..... 206/563; 220/574; 220/737; 220/914

(58) Field of Classification Search ..... 220/28.8, 220/556, 575, 914, 57; 206/562–564; 294/143, 294/144, 172
See application file for complete search history.

(56) References Cited

U.S. PATENT DOCUMENTS

| | | | | |
|---|---|---|---|---|
| 3,315,858 | A * | 4/1967 | Horner | 294/143 |
| 3,504,832 | A * | 4/1970 | Corvetti | 294/144 |
| D227,851 | S | 7/1973 | Nowland et al. | |
| 5,346,070 | A | 9/1994 | McSpadden | |
| 5,353,952 | A | 10/1994 | Douche | |
| 5,697,512 | A | 12/1997 | Brickley | |
| 5,769,264 | A * | 6/1998 | Lipkowitz | 220/575 |
| 5,950,856 | A * | 9/1999 | Cinque | 220/23.4 |
| 6,029,938 | A | 2/2000 | Fava | |
| 6,264,026 | B1 * | 7/2001 | Bradley | 206/217 |
| 6,622,885 | B1 * | 9/2003 | Erman | 220/571 |
| 6,702,141 | B1 | 3/2004 | Cinque | |
| 6,923,485 | B1 * | 8/2005 | Bauswell | 294/3.5 |
| 7,243,786 | B2 * | 7/2007 | Sollazzo | 206/201 |
| 2005/0056192 | A1 | 3/2005 | Marchand | |
| 2008/0173567 | A1 * | 7/2008 | Magee | 206/562 |

* cited by examiner

*Primary Examiner* — Harry Grosso
(74) *Attorney, Agent, or Firm* — Richard C. Litman

(57) ABSTRACT

Food and drink trays have flat surfaces and peripheral edges with openings adapted for receiving and securely carrying a plurality of beverage and food containers. A bearing member attachable to a tray has an arched configuration and fits over the forearm of a user, while a gripping member attachable to the tray is adapted for gripping by a user's hand. A second embodiment has a pair of large circular openings on the upper surface that will hold full plates of food. The food and drink carrying tray may be made from wood, or from a lightweight material, such as plastic, and is useful for holding a plurality of beverages and plates of food when dining buffet-style in a restaurant or a home dinner party. Additional embodiments have removable grips and removable bearing members, as well as large food trays capable of receiving a variety of container-holding adapters.

10 Claims, 18 Drawing Sheets

FOOD AND DRINK TRAY

CROSS-REFERENCE TO RELATED APPLICATION

This application claims the benefit of U.S. Provisional Patent Application Ser. No. 61/202,562, filed Mar. 12, 2009.

BACKGROUND OF THE INVENTION

1. Field of the Invention

The present invention relates to trays and carriers, and more particularly, to a food and drink carrying tray that fits over the forearm and has openings to hold cups and plates.

2. Description of the Related Art

A buffet is a meal serving system where patrons or guests serve themselves. It is a popular method of feeding large numbers of people with minimal staff, or when having large numbers of people in an individual home.

The modern buffet was developed in France in the 18th century, and soon spread throughout Europe. The term originally referred to the sideboard where the food was served, but eventually became applied to the form. The buffet became popular in the English-speaking world in the second half of the nineteenth century.

Buffets are effective for serving large numbers of people at once. For this reason, they are prevalent in institutional setting, such as business conventions or large catered parties. Another advantage of buffets compared to table service is that diners have a great deal of choice and the ability to closely inspect food before selecting it. Since a buffet involves diners serving themselves, it has in the past been considered an informal form of dining, less elegant than table service. In recent years, however, buffet dinners are increasingly popular among hosts of home dinner parties, especially in homes where limited kitchen space complicates the serving of individual plates.

In addition to home dinner parties, buffets are a popular form of dining in many hotels and resorts, especially in Las Vegas, Nev. and Atlantic City, N.J., where they are typically very large and boast a wide variety of foods. There are a growing number of restaurant chains that specialize in buffet style dining, and buffets are often found on ocean liners and cruise ships.

In many large buffets and in some home dinner parties, the salads and side dishes are prepared and served separate from the entrees. Often, cocktails are served as well as other beverages. The use of multiple plates and beverage containers is necessary in these situations.

Juggling multiple plates of food and beverage containers can be difficult, especially in a large buffet area or in a standing cocktail party situation. Guests must either make multiple trips through the buffet line, or attempt to hold their drinks and food without spilling. Additionally, there is often a shortage of appropriate flat surfaces or seating, making the situation even more difficult and increasing the likelihood of spills and accidents. There is a need, therefore, for a food and drink carrying tray that can safely hold multiple beverages and plates of food.

Thus, a food and drink tray solving the aforementioned problems is desired.

SUMMARY OF THE INVENTION

The food and drink tray has a planar upper surface with a peripheral edge that has a plurality of openings for receiving beverage containers. A bearing member is connected to the bottom surface of the tray and has an arched configuration adapted for fitting across the forearm of a user. A front gripping member is connected to the bottom surface of the tray near the front and is adapted for being grasped by the hand of the user. The bearing member and the front gripping member may also support the food and drink carrying tray on a flat surface.

A second embodiment of the food and drink carrying tray has an upper surface with a rounded edge having two circular openings adapted for receiving plates of food. The bearing member and the front gripping member may support this embodiment of the food and drink carrying tray on a flat surface. Multiple embodiments are described which address a variety of food and drink container styles.

The food and drink carrying tray may be most useful in a buffet or house party situation, but may also be used by professional food service persons. The food and drink carrying tray may be made of wood for stability, or may be formed from a lightweight material such as plastic, for ease of storage and stackability.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
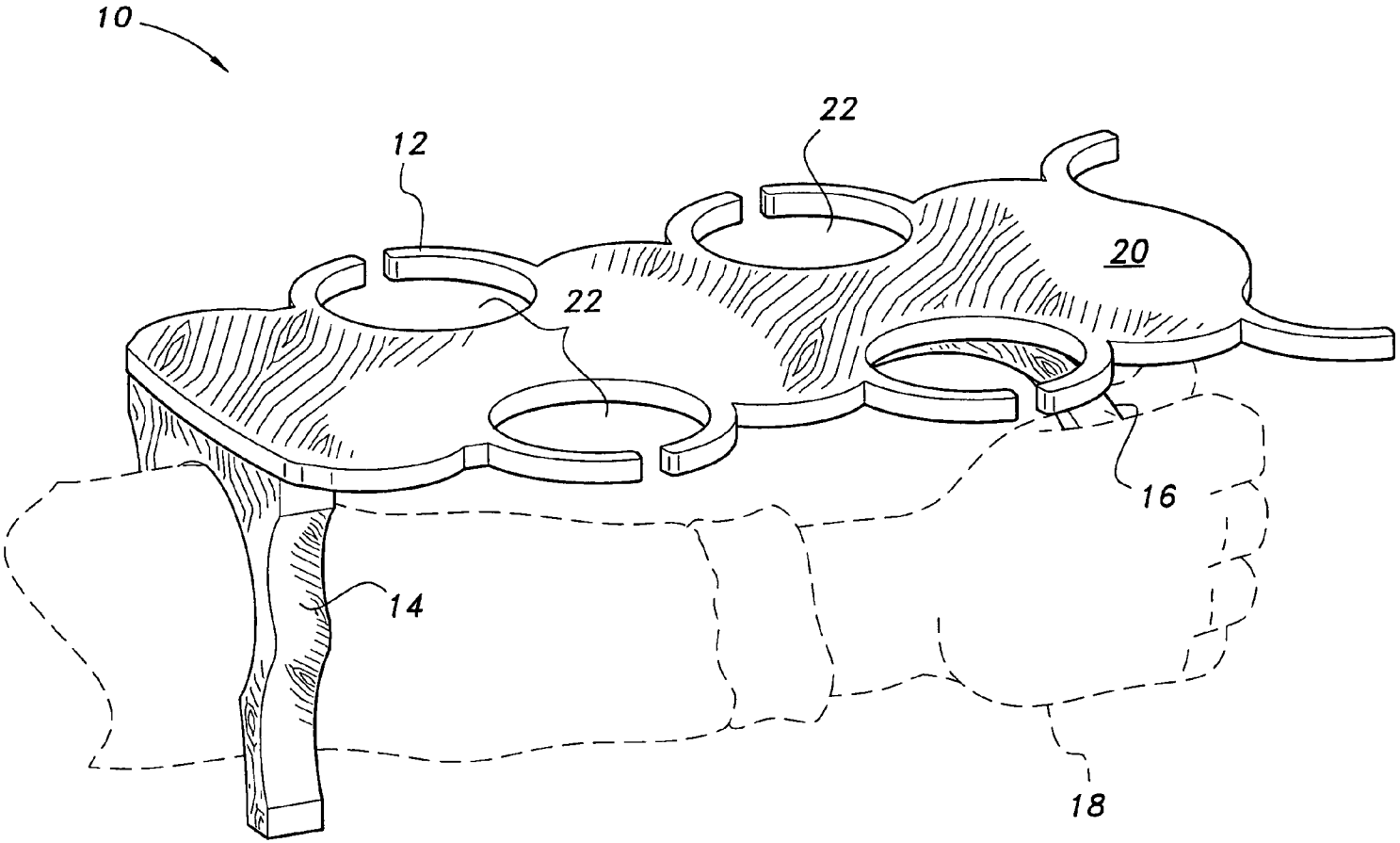
FIG. 1 is an environmental, perspective view of a first embodiment of a food and drink carrying tray according to the present invention, configured for carrying beverages.

The present invention relates to a food and drink carrying tray. Referring first to FIG. 1, a food and drink carrying tray 10 is shown held by a user 18, shown in phantom. The food and drink carrying tray 10 has a top surface 20 with an edge 12 that has a plurality of openings 22 adapted for receiving beverage containers. A bearing member 14 is attached to the bottom of the food and drink carrying tray 10, and is adapted for resting on the forearm of a user 18. A gripping member 16 is connected to the bottom of the food and drink carrying tray 10 and is adapted for grasping by the hand of a user 18.

Figure 2:
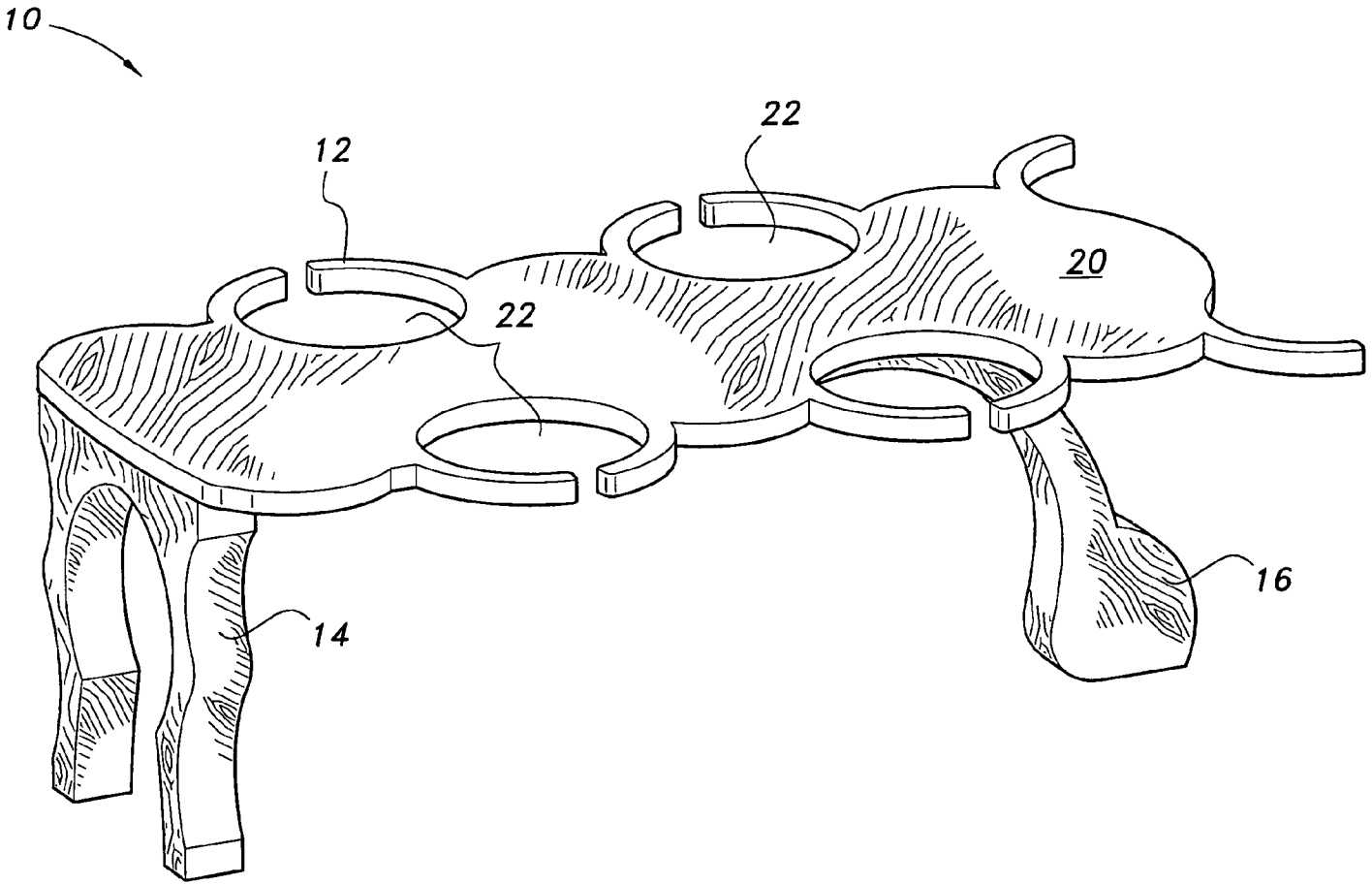
FIG. 2 is a perspective view of a food and drink carrying tray according to the present invention, configured for carrying beverages.

FIG. 2 is a perspective view of a food and drink carrying tray 10 showing the gripping member 16 and the bearing member 14. It should be noted that the gripping member 16 and the bearing member 14 can support the drink carrying tray 10 on a flat surface.

Figure 3:
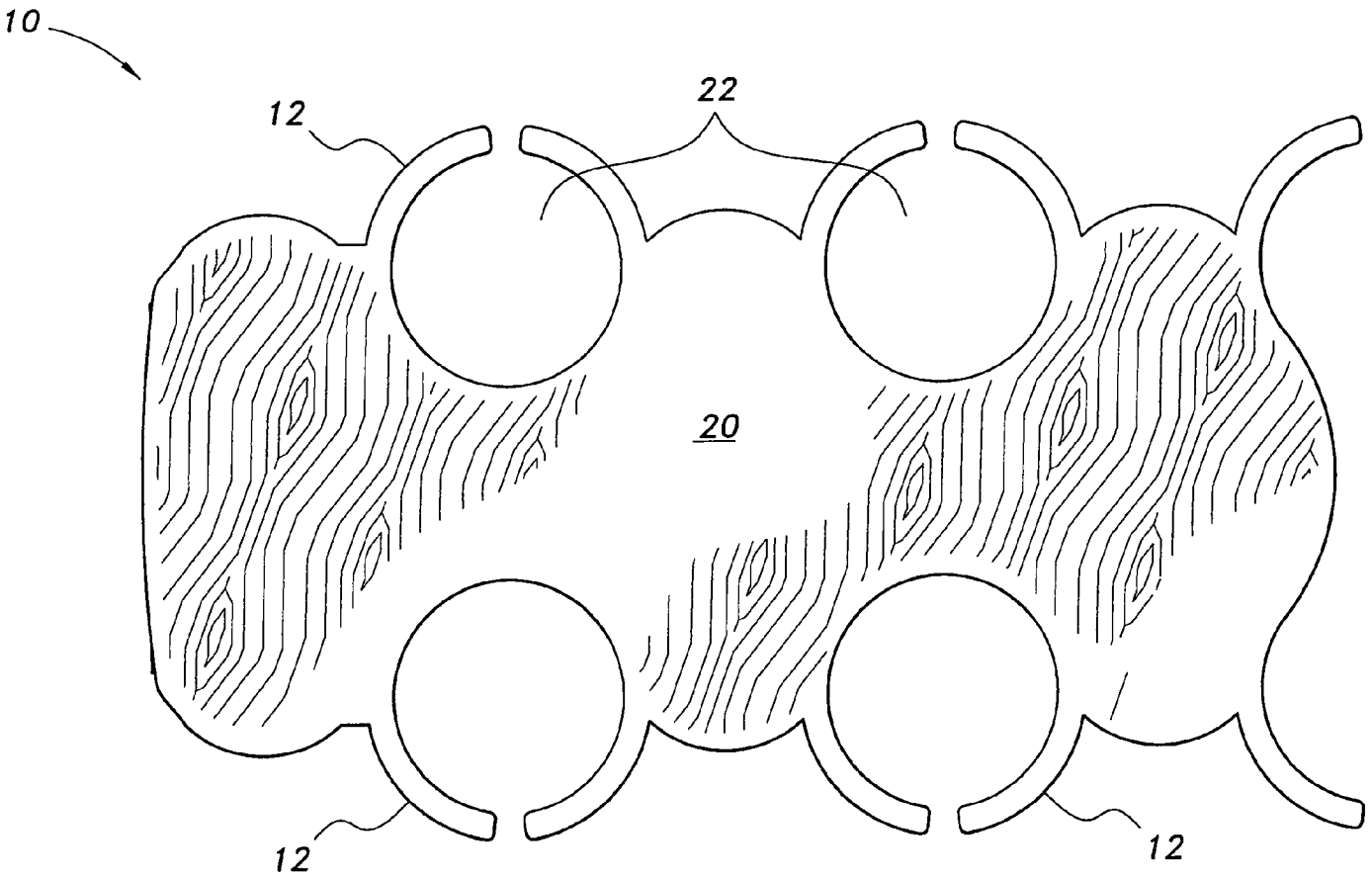
FIG. 3 is a plan view of a food and drink carrying tray according to the present invention, configured for carrying beverage.

FIG. 3 is a plan view of a food and drink carrying tray 10 showing the configuration of the openings 22 and the peripheral edge 12 adapted for receiving a beverage container.

Figure 4:
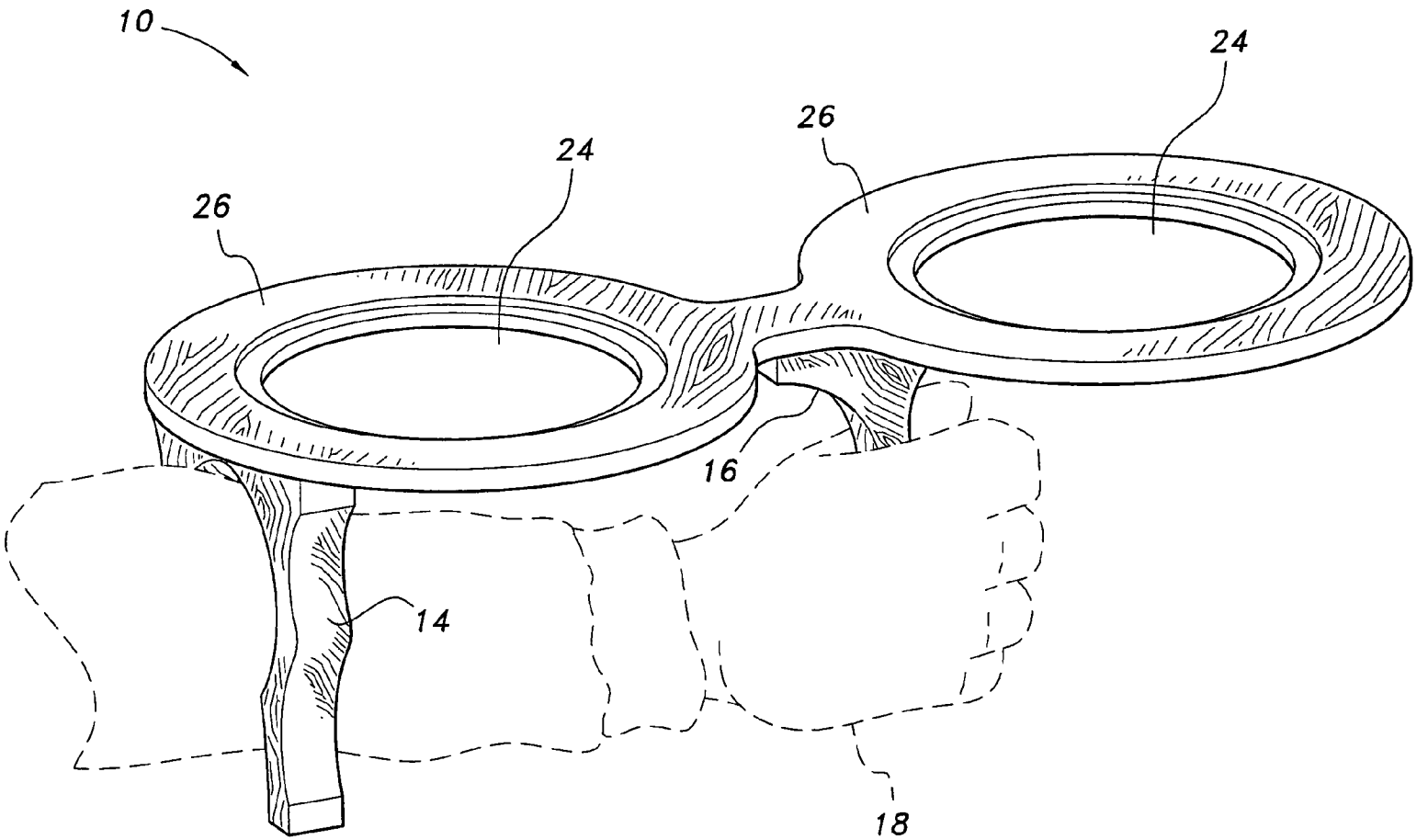
FIG. 4 is an environmental, perspective view of a second embodiment of a food and drink carrying tray according to the present invention, configured for carrying plates.

FIG. 4 shows a second embodiment of a food and drink carrying tray 10 held by a user 18, shown in phantom. The bearing member 14 rests on the forearm of the user 18, and the hand of the user 18 grasps the gripping member 16. The circular upper surface 26 has a plurality of openings 24 adapted for receiving a plate of food.

Figure 5:
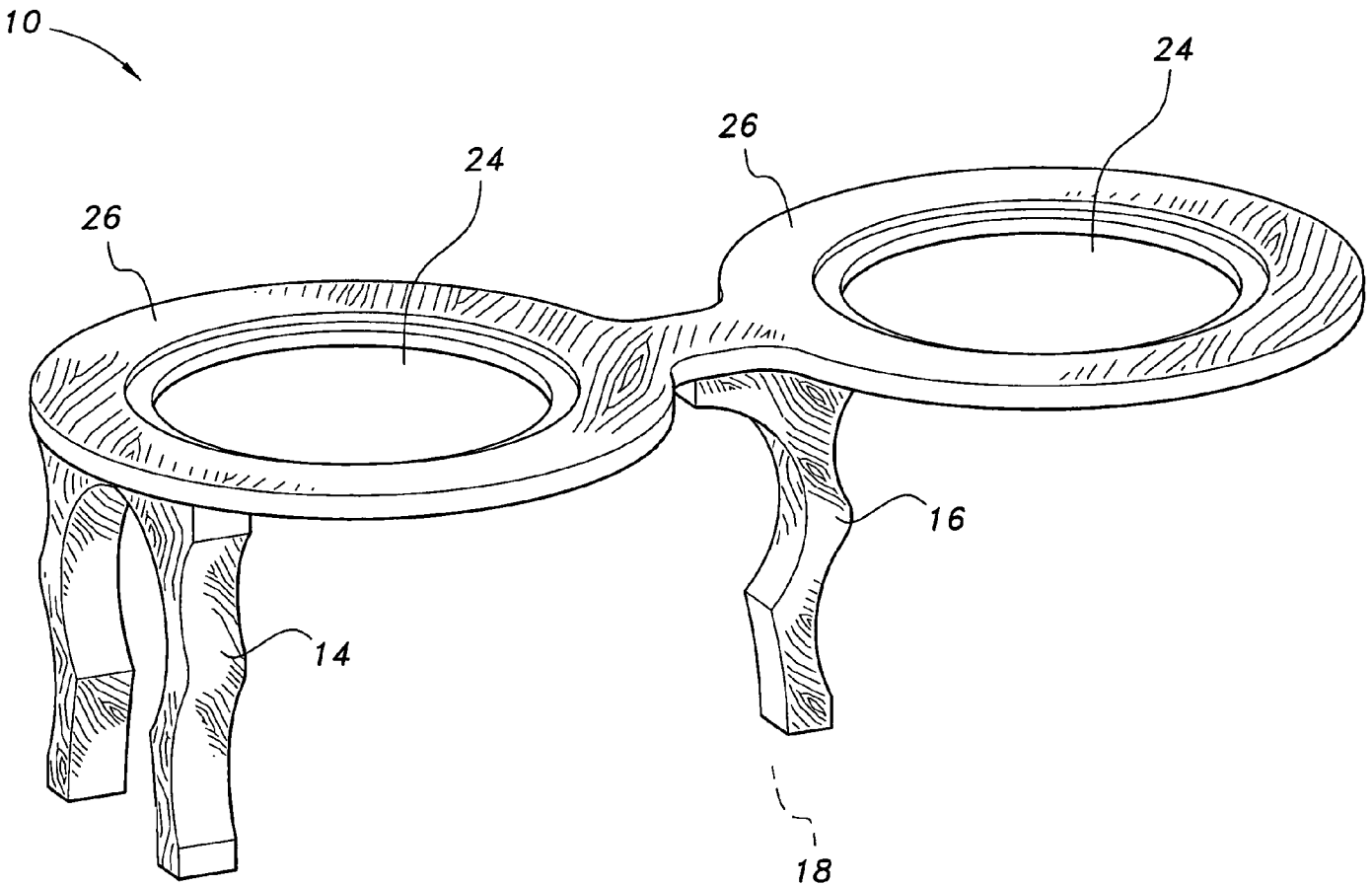
FIG. 5 is a perspective view of a food and drink carrying tray according to the present invention, configured for carrying plates.

FIG. 5 is a perspective view of a food and drink carrying tray having a gripping member 16 and a bearing member 16 that can support the food and drink carrying tray 10 on a flat surface.

Figure 6:
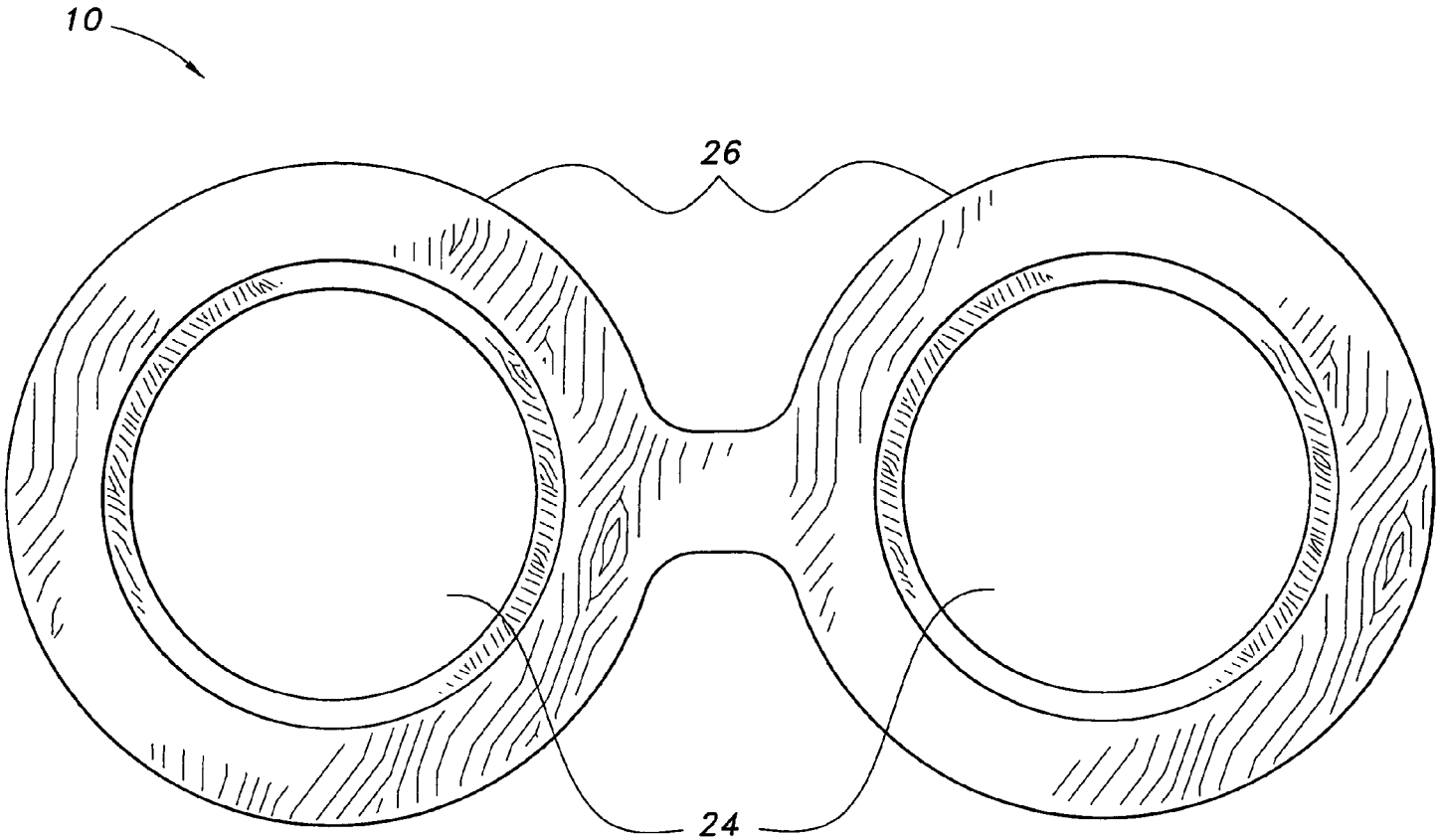
FIG. 6 is a plan view of a food and drink carrying tray according to the present invention, configured for carrying plates.

FIG. 6 is a plan view of a food and drink carrying tray showing the circular upper surface 26 and the openings 24 that are adapted for receiving a plate of food.

Figure 7:
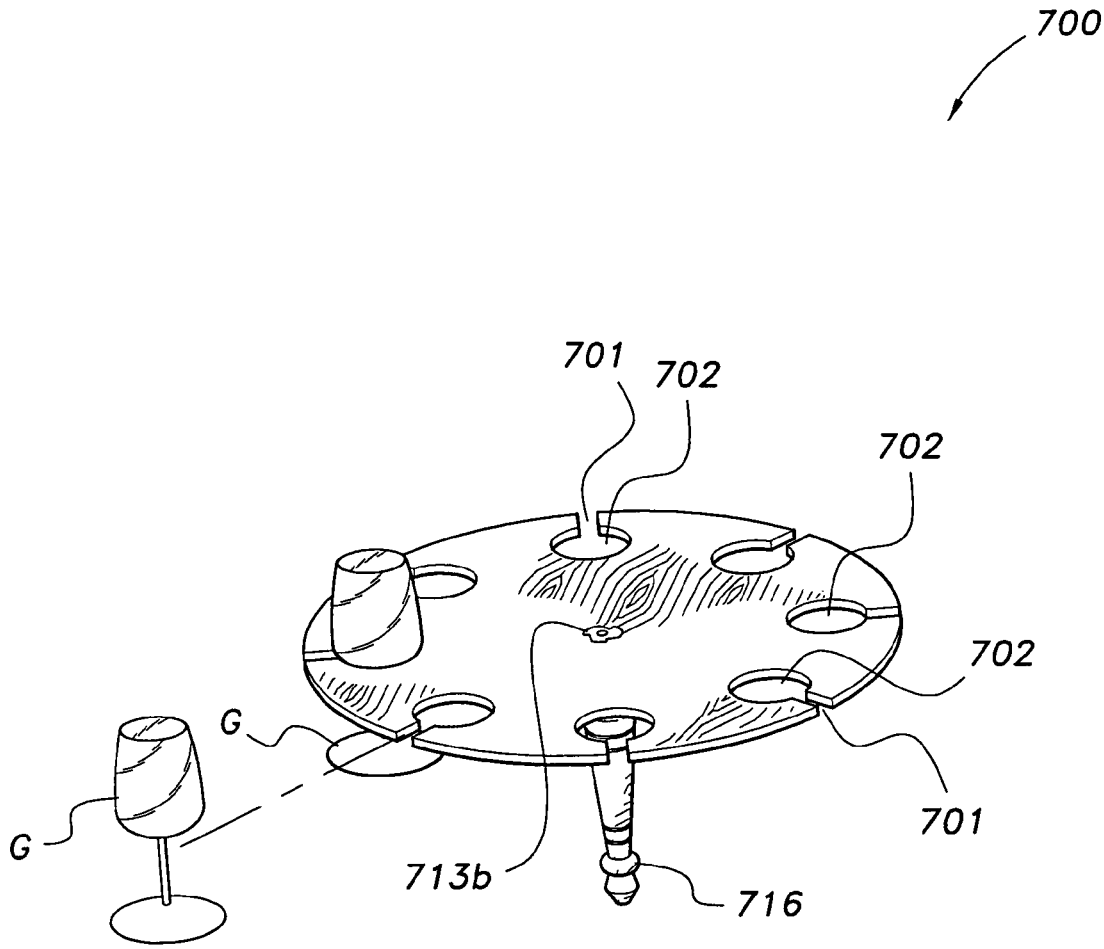
FIG. 7 is a top perspective view of a food and drink carrying tray, having a threaded removable grip according to the present invention.
Figure 8:
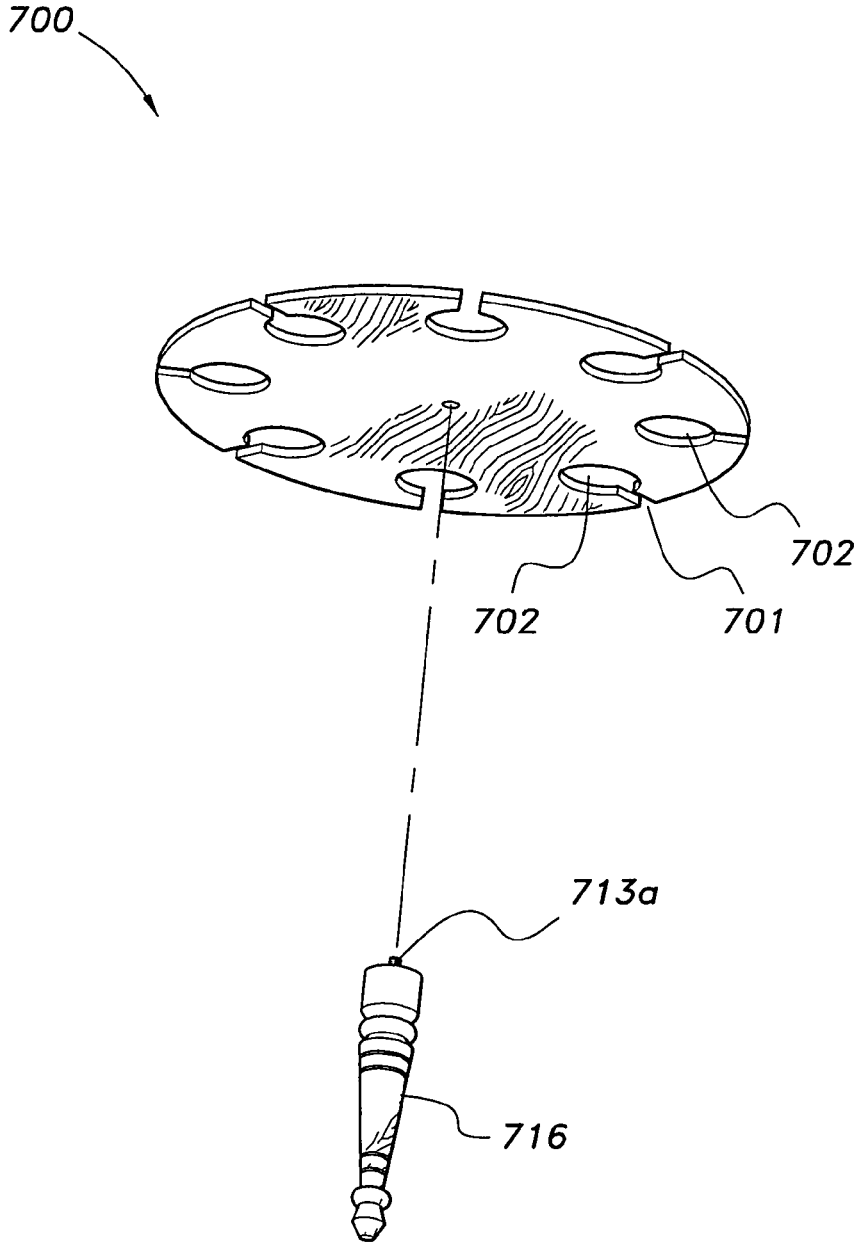
FIG. 8 is a bottom perspective view of the food and drink carrying tray of FIG. 7 according to the present invention.

As shown in FIGS. 7-8, a threaded removable grip 716 having screw portion 713*a* is threadably attachable preferably to an axial center of wine glass beverage and food tray 700 via threaded receiving insert 713*b*. It should be understood that the slots 701 extending from the periphery of the tray into the tray openings 702 facilitate insertion of a goblet styled glass G into the tray via the glass stem.

Figure 9:
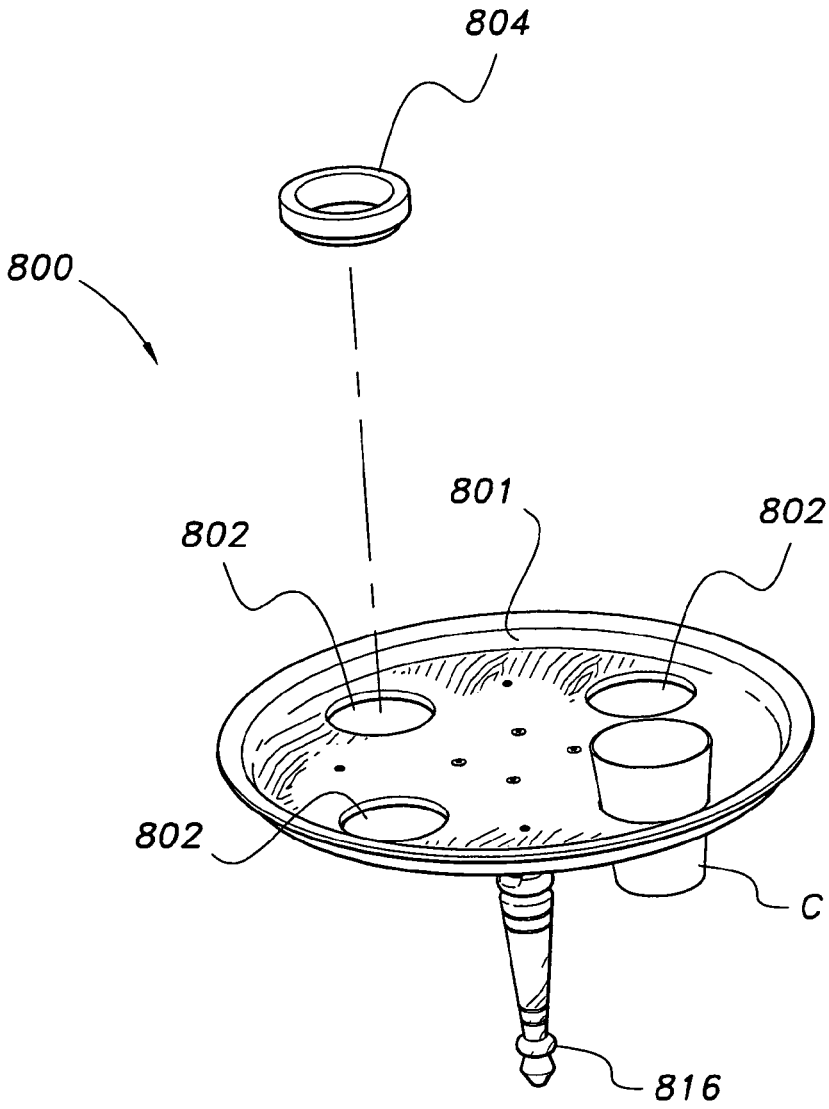
FIG. 9 is a partially exploded, top perspective view of a food and drink carrying tray with drink cup adapter, according to the present invention.
Figure 10:
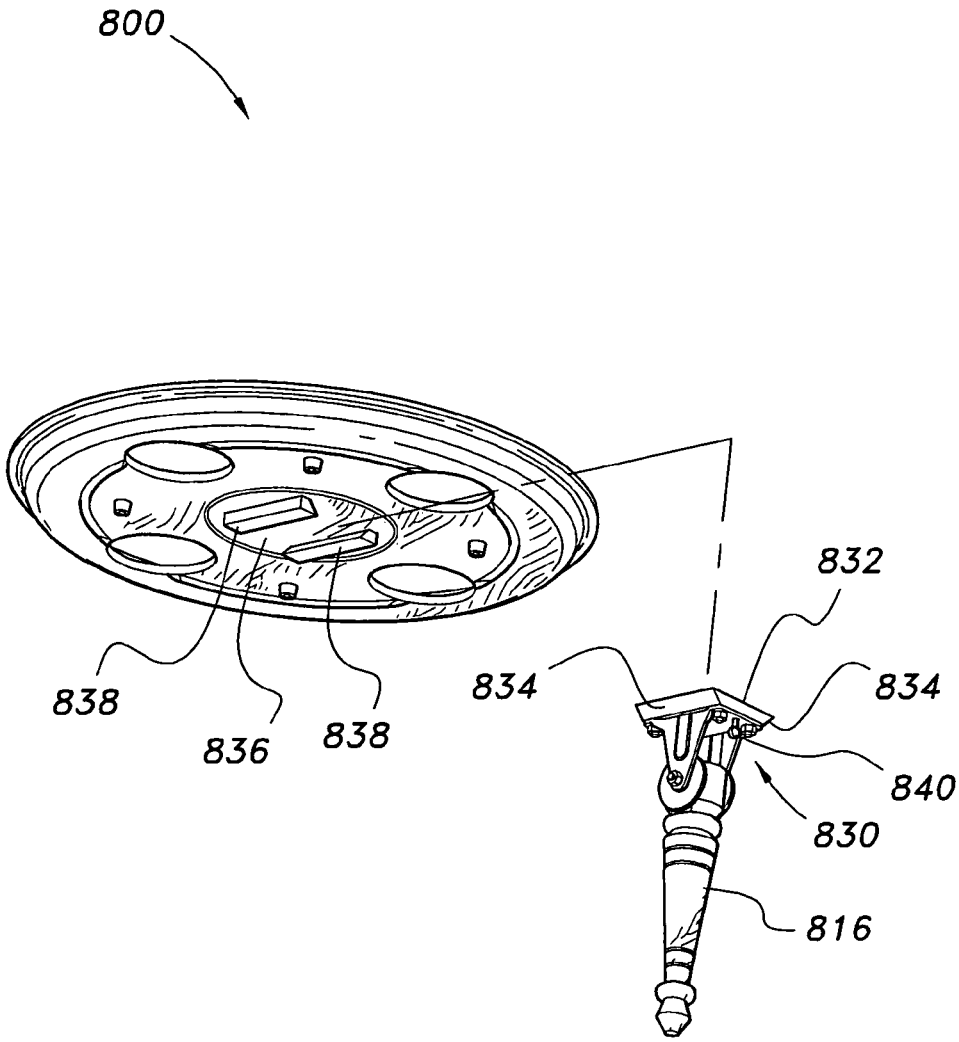
FIG. 10 is an exploded, bottom perspective view of the food and drink carrying tray of FIG. 9 according to the present invention.

As shown in FIG. 9, a drink cup tray 800 has a peripheral raised wall 801 to assist in preventing items from sliding off the tray. Holes 802 which can receive drink cups C are disposed in the tray 800. Alternatively, there is a drink cup adapter 804 which can be received by the tray holes 802 to accommodate a smaller drink container. As shown in FIG. 10, a pivotal grip 816 is slidably and removably attachable to a bottom portion of the tray 800 near the tray's axial center. Attachment member 830 of grip 816 is comprised of a block 832 having parallel arranged chamfered elongate edges 834. An attachment base 836 is permanently attached to the bottom of tray 800 and has complementarily fitting chamfered receiving members 838 that slidably engage the chamfered elongate members 834 of attachment member 830 for attachment of the grip 816 to the base 836 of the tray 800. A friction type fastener 840 is threadably engaged with the attachment member 830 and can be tightened against the base 836 to retain the attachment member 830 of grip 816 against the base 836 of tray 800.

Figure 11:
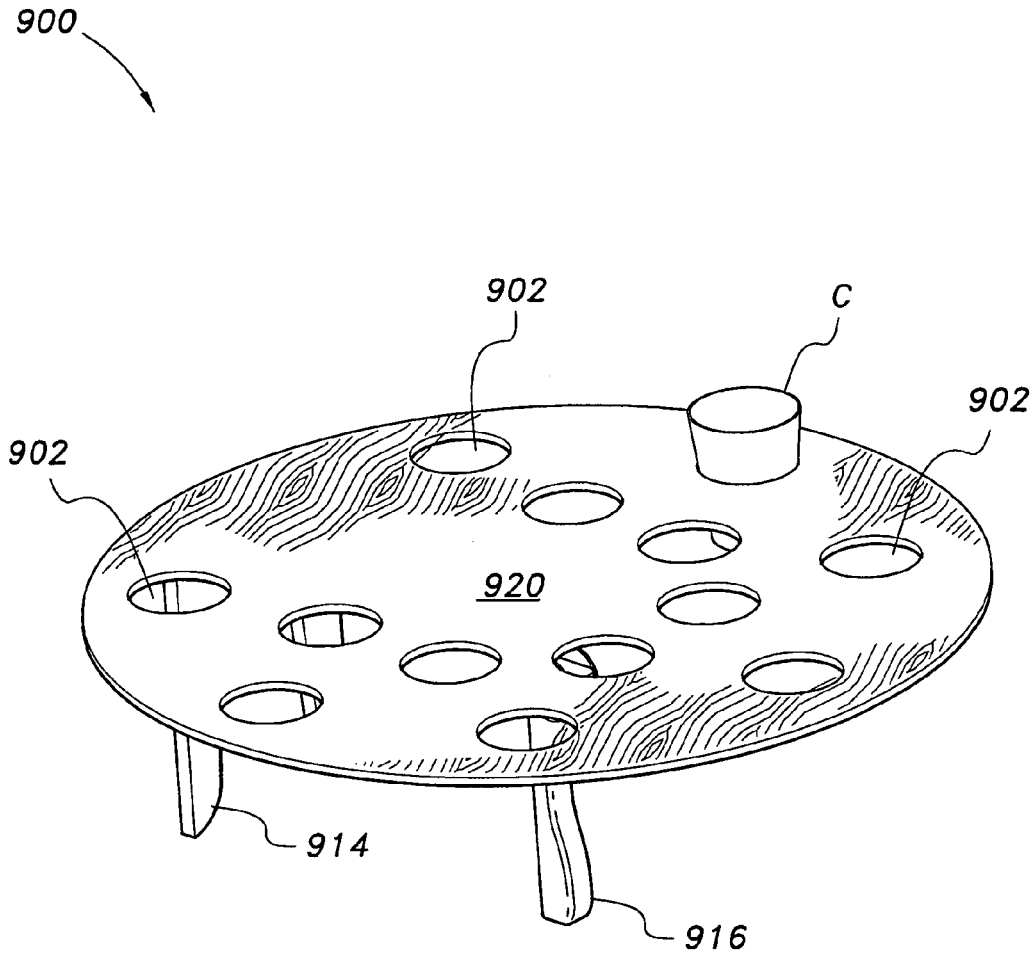
FIG. 11 is a top perspective view of a large food and drink carrying tray, according to the present invention.

As shown in FIG. 11, a large, planar drink cup tray 900 has a top surface 920 with holes 902 which can receive at least one drink cup C. A bearing member 914 is removably attachable to the bottom of the food and drink carrying tray 900, and is adapted for resting on the forearm of a user. A gripping member 916 is removably attachable to the bottom of the food and drink carrying tray 900 and is adapted for grasping by the hand of a user.

Figure 12:
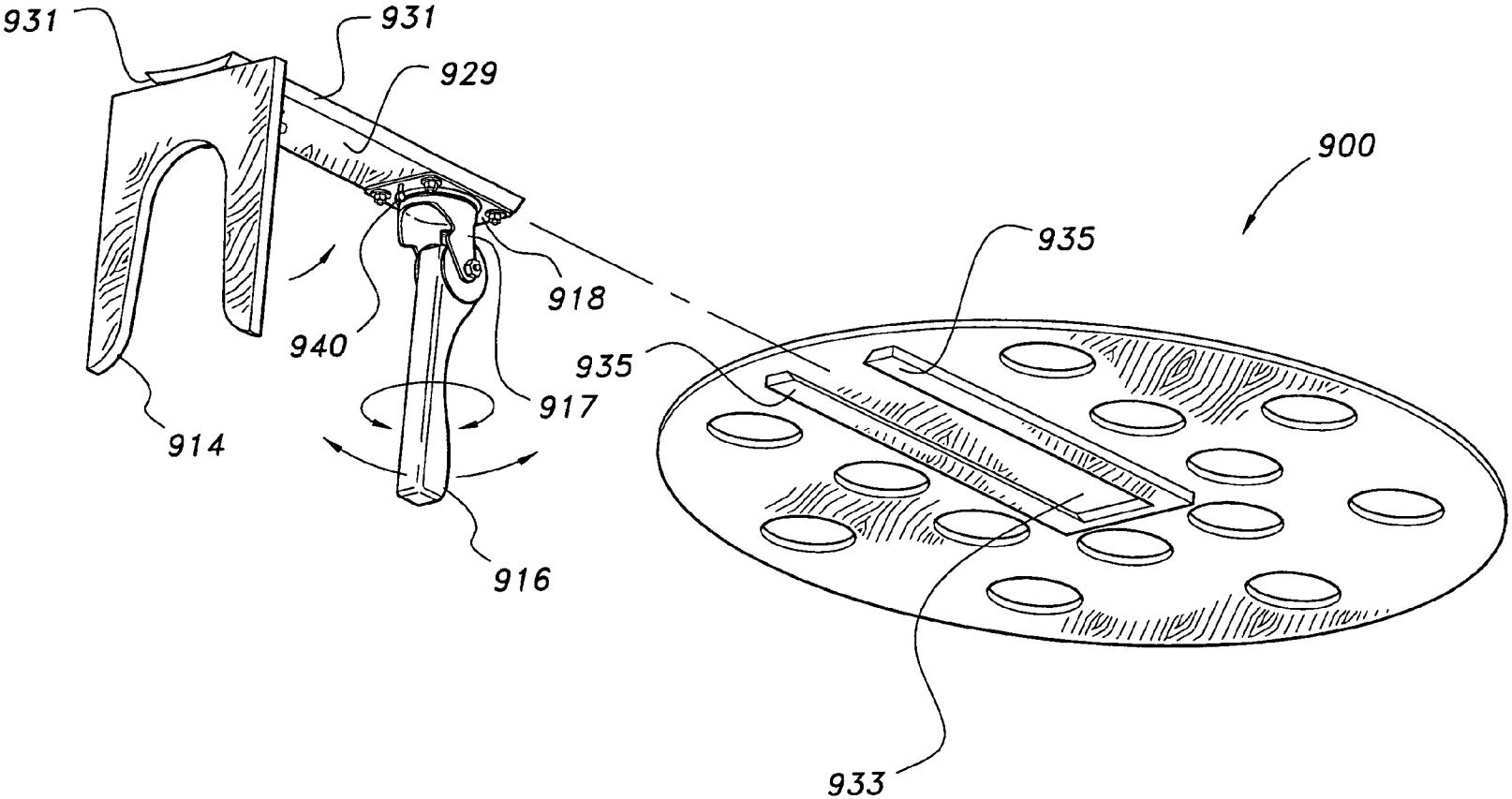
FIG. 12 is a bottom perspective view of the large food and drink carrying tray of FIG. 11, according to the present invention.

As shown in FIG. 12, pivotal and rotatable gripping member 916 is slidably and removably attachable to the bottom of tray 900. Bearing member 914 is also removably attachable to bottom portion of the tray 920. Grip 916 and bearing 914 members are attached to grip and bearing member attachment plate 929 proximate opposing ends of the grip and bearing attachment plate 929. The grip and bearing attachment plate 929 has parallel arranged chamfered peripheral edges 931. An attachment base 933 is formed in the bottom of the tray 920 and has complementarily fitting chamfered receiving members 935 that slidably engage the chamfered peripheral edges 931 of the grip and bearing attachment plate 929 for attachment of the grip and bearing member to the base 933 of the tray 900. A friction type fastener 940 is threadably engaged with the grip and bearing attachment plate 929 and can be tightened against the base 933 to retain the grip and bearing attachment plate 929 against the base 933 of tray 900.

Figure 14:
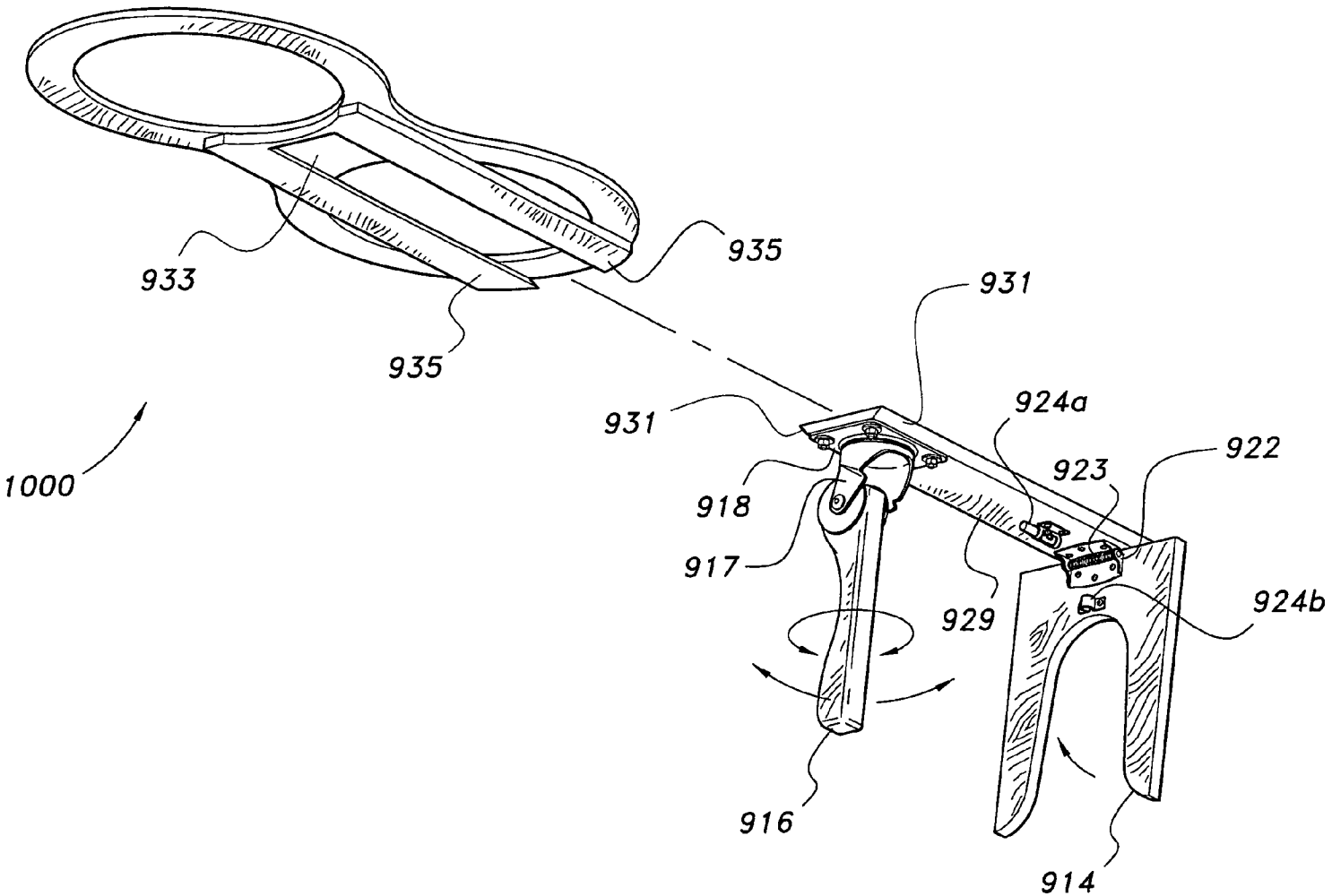
FIG. 14 is an exploded, bottom perspective view of the dual adapter food and drink carrying tray of FIG. 13 according to the present invention.

As most clearly shown in FIG. 14, hinge members 922 in combination with coil spring 923 pivotally attach the bearing member 914 to the grip and bearing attachment plate 929 and provide a spring bias that biases the bearing member 914 into an extended position. When not in use, the bearing member 914 can be pivotally folded adjacent to the grip and bearing attachment member 929 and can be locked into the folded position by engagement of latch 924*a* of the grip and bearing attachment plate 929 with latch keeper 924*b* of the bearing member 914. The grip 916 pivotally attaches to pivot flanges 917, which, in turn, are attached to the grip and bearing attachment member 929 via roller bearing plate 918. This arrangement allows the grip 916 to tilt and rotate while being attached to the under side of various trays described herein.

Figure 13:
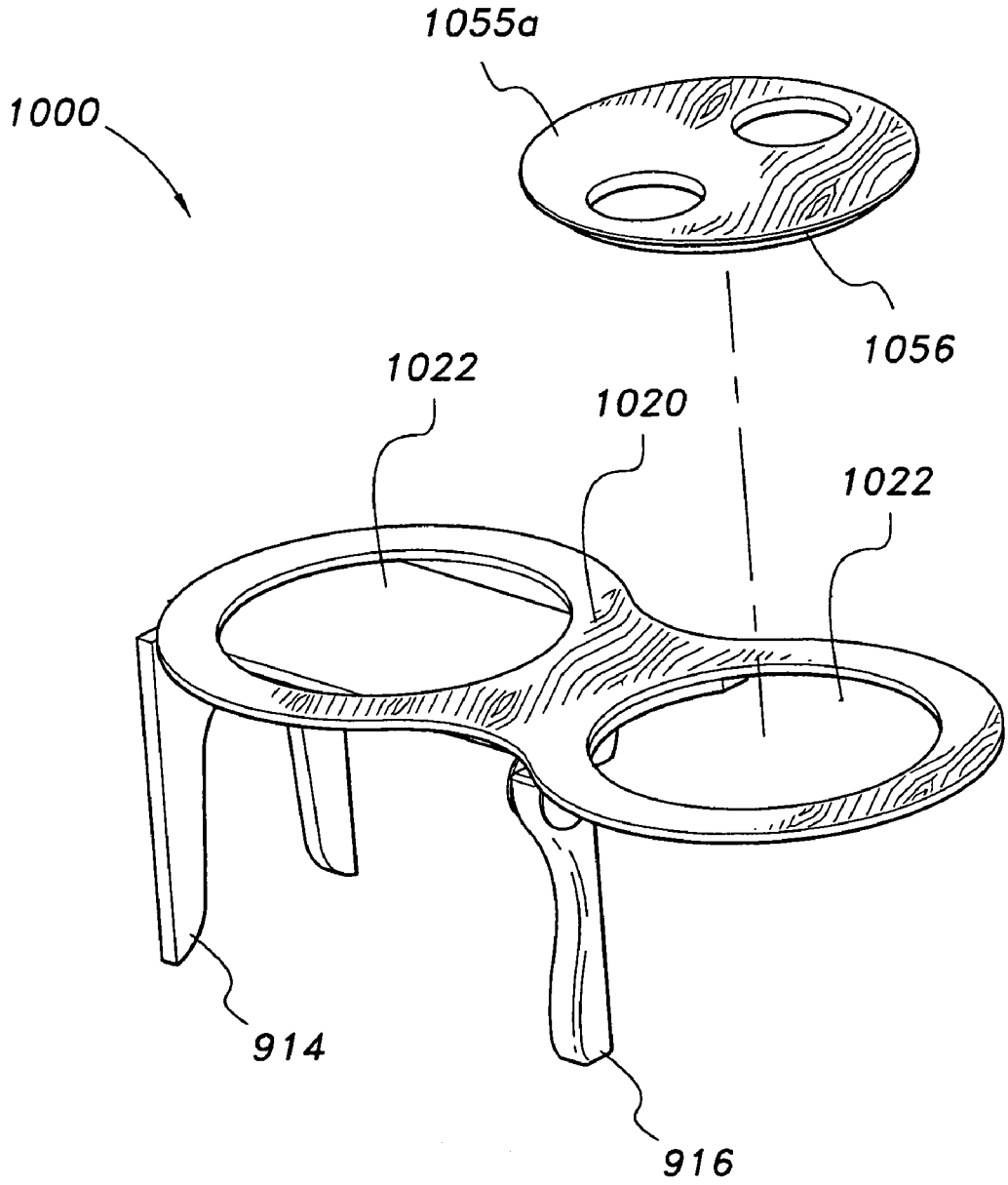
FIG. 13 is a partially exploded, top perspective view of a dual adapter food and drink carrying tray and insert according to the present invention.
Figure 15:
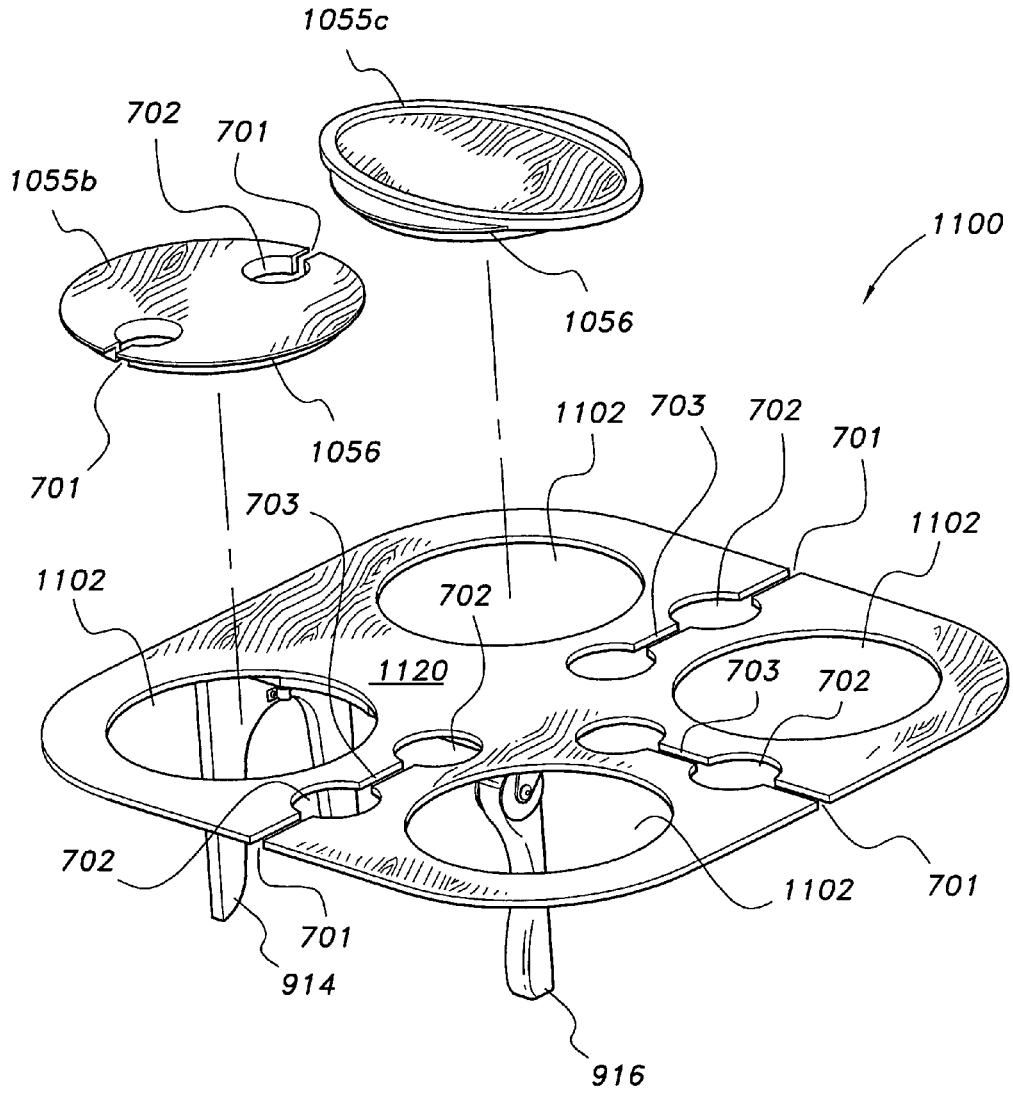
FIG. 15 is a partially exploded, top perspective view of a quad adapter food and drink carrying tray and inserts according to the present invention.
Figure 16:
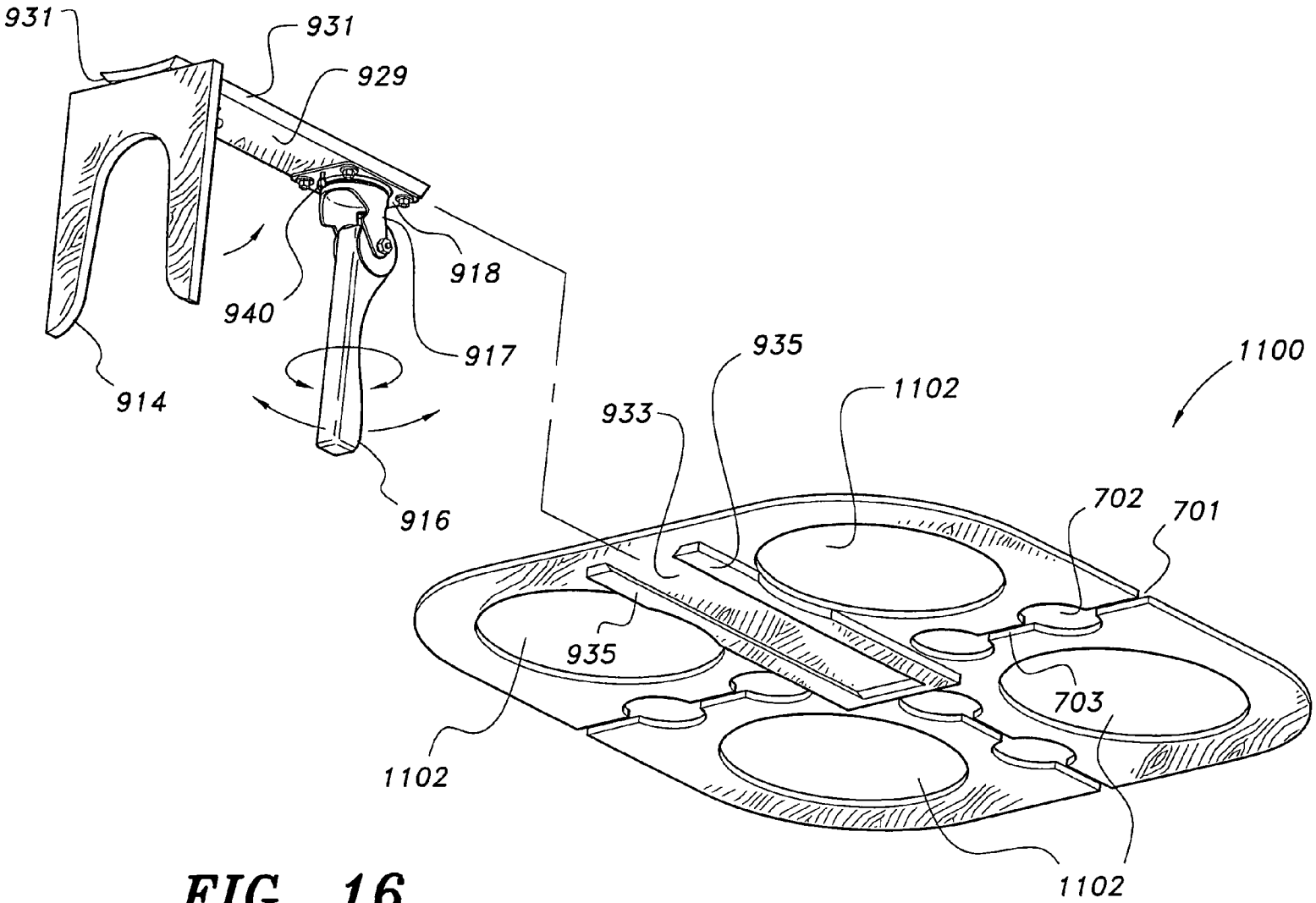
FIG. 16 is an exploded, bottom perspective view of the quad adapter food and drink carrying tray of FIG. 15 according to the present invention.
Figure 17:
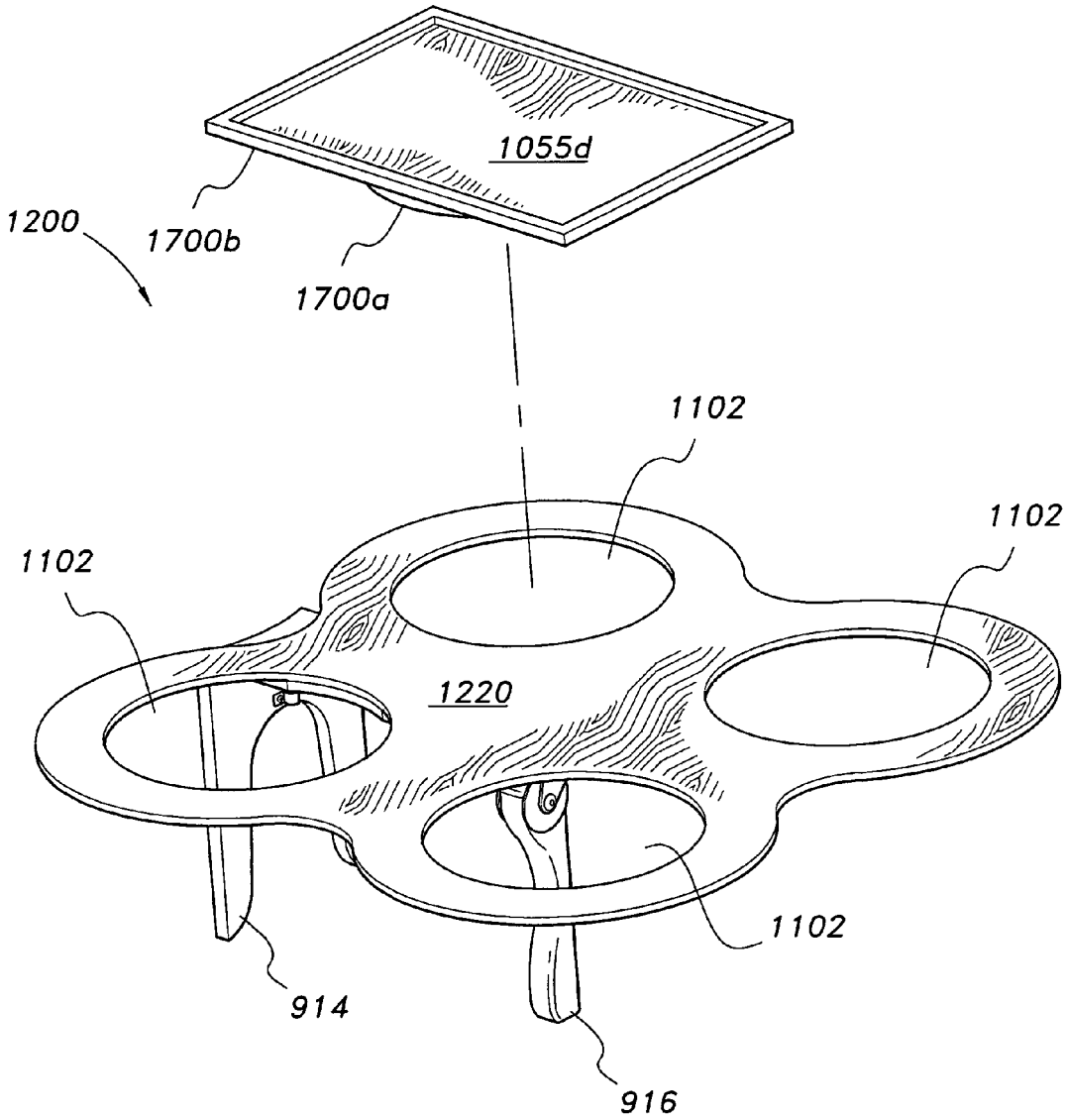
FIG. 17 is a partially exploded, top perspective view of an alternative quad adapter food and drink carrying tray and inserts according to the present invention.
Figure 18:
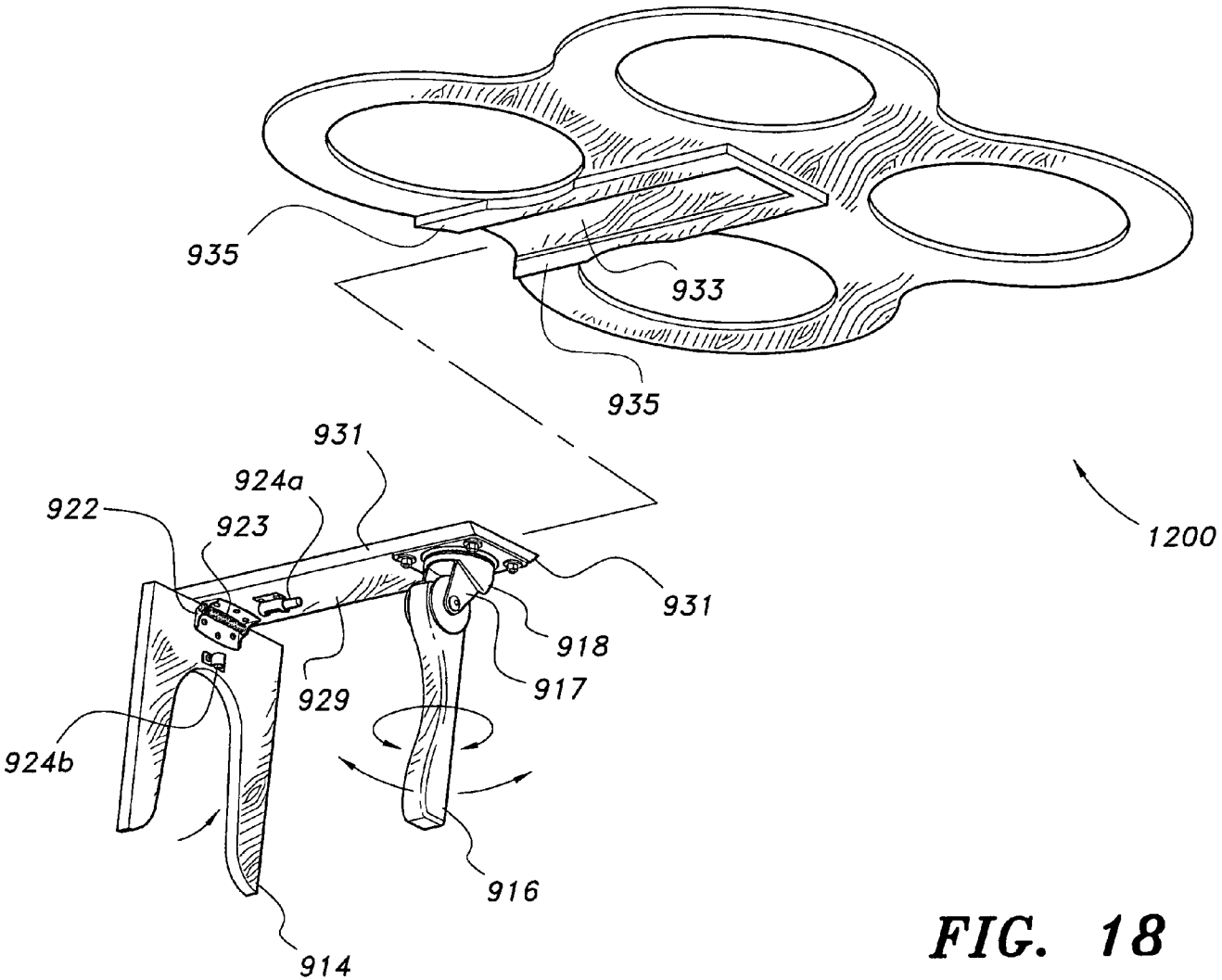
FIG. 18 is an exploded, bottom perspective view of the alternative quad adapter food and drink carrying tray of FIG. 17 according to the present invention.

As shown in FIGS. 13 and 14, the aforementioned combination of bearing member 914 and grip 916 can be attached to an elongate dual adapter food and drink carrying tray 1000. The tray 1000 has a top surface 1020 that has two large openings 1022 proximate opposing ends of the tray. The large openings 1022 may accommodate a large bowl, or preferably receive adapters such as flanged adapter 1055*a*, which, via flange 1056 fits into the opening 1022. Adapter 1055*a* is designed to receive a pair of drink containers. Similarly, as shown in FIGS. 15-16 the aforementioned combination of bearing member 914 and grip 916 can be attached to quad adapter food and drink carrying tray 1100. Top surface 1120 of tray 1100 has four symmetrically opposed large openings 1102. The large openings 1102 may accommodate a large bowl, or preferably receive adapters such as adapter 1055*a*, 1055*b*, 1055*c* which fit into the opening 1102. It should be understood that the slots 701 extending from the periphery of the tray into the tray openings 702 facilitate insertion of a goblet styled beverage containers into the tray via a glass stem. Openings 702 may be interconnected via slot 703 to facilitate placement options of the stemmed glasses. Adapters 1055*a*, 1055*b*, 1055*c* are designed to receive various plate and drink containers. As shown in FIGS. 17-18, the aforementioned combination of bearing member 914 and grip 916 can be attached to large tray 1200 having top surface 1220. Top surface 1220 of large tray 1200 has holes 110*s* that accommodate large bowls or food plate adapter tray 1055*d*, for example. Adapter tray 1055*d* has a bottom surface 1700*b*. Circular boss 1700*a* extending from bottom surface 1700*b* creates a flange that fits on top of top surface 1220 to secure the adapter tray 1055*d* to the large tray 1200.

It is to be understood that the present invention is not limited to the embodiments described above, but encompasses any and all embodiments within the scope of the following claims.

I claim:

1. A food and drink carrying tray, comprising:

a planar member having a peripheral edge, a top surface having at least one circular opening adapted for receiving a plate of food, and a bottom surface, the bottom surface having a bearing member adjacent the peripheral edge, the bearing member being removable from the bottom surface of the planar member and adapted for resting on a forearm of a user;

a gripping member disposed on the bottom surface, the gripping member being removable from the bottom surface of the planar member and adapted for being grasped by the hand of a user; and an elongate member removably attachable to the bottom surface of the planar member, wherein the bearing member and the gripping member are attached to the elongate member, further wherein the bearing member has a locking pivotal attachment to the elongate member, the bearing member being spring-biased to pivot in an open position extending downward from the elongate member, the bearing member being lockable to a closed position in which the bearing member is folded adjacent to the elongate member.

2. The food and drink tray according to claim 1, wherein said gripping member has a swivel attachment to said elongate member, thereby allowing said gripping member to swivel about an axis perpendicular to a longitudinal axis of said elongate member.

3. The food and drink tray according to claim 2, wherein said gripping member is pivotally attached to said elongate member, thereby allowing a grip portion of said gripping member to extend forward or backward in relation to said elongate member.

4. The food and drink tray according to claim 1, further comprising a flanged planar adapter member fitting over the food plate opening, the flanged planar adaptor member having at least one hole adapted to receive a beverage container, thereby converting the food plate opening into a beverage container opening.

5. The food and drink tray according to claim 1, further comprising a flanged planar adapter member fitting over the food plate opening, the flanged planar adapter member being adapted to receive a food tray, thereby converting the food plate opening into a food tray holder.

6. The food and drink tray according to claim 1, further comprising a flanged planar adapter member fitting over the food plate opening, the flanged planar adaptor member being adapted to receive a bowl, thereby converting the food plate opening into a bowl holder.

7. The food and drink tray according to claim 1, wherein the food and drink carrying planar member has a plurality of holes adapted for receiving beverage containers.

8. The food and drink tray according to claim 7, wherein said planar member has slots extending from the peripheral edge and connecting at least a pair of the holes adapted for receiving beverage containers, the slots being adapted for allowing a glass stem to pass through.

9. A food and drink carrying tray, comprising:

a planar member having a peripheral edge, a top surface having at least one opening adapted for receiving a plate of food, and a bottom surface, the bottom surface having a bearing member adjacent the peripheral edge, the bearing member being adapted for resting on a forearm of a user;

a gripping member disposed on the bottom surface, the gripping member being adapted for being grasped by the hand of a user; and a flanged planar adapter member fitting over the at least one opening, the flanged planar adaptor member having at least one hole adapted to receive a beverage container, thereby converting the at least one opening into a beverage container opening.

10. A food and drink carrying tray, comprising:

a planar member having a peripheral edge, a top surface having at least one opening adapted for receiving a plate of food, and a bottom surface, the bottom surface having a bearing member adjacent the peripheral edge, the bearing member being adapted for resting on a forearm of a user;

a gripping member disposed on the bottom surface, the gripping member being adapted for being grasped by the hand of a user; and a plurality of flanged planar adapter members selectively fitting over the at least one opening, each of the flanged planar adaptor members being distinctly configured to correspond to a respective food container, thereby converting the at least one opening into a distinct food container holder.

* * * * *